US006364307B2

(12) United States Patent
Leu

(10) Patent No.: US 6,364,307 B2
(45) Date of Patent: Apr. 2, 2002

(54) APPARATUS FOR FEEDING SHEET-LIKE ARTICLES FROM A STACK

(75) Inventor: Willy Leu, Pfäffikon (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/921,744

(22) Filed: Aug. 3, 2001

Related U.S. Application Data

(63) Continuation of application No. PCT/CH99/00529, filed on Nov. 10, 1999.

(30) Foreign Application Priority Data

Feb. 5, 1999 (CH) ..... 0227/99

(51) Int. Cl.[7] ..... B65H 5/08
(52) U.S. Cl. ..... 271/11; 271/12; 271/106; 271/107
(58) Field of Search ..... 271/11, 12, 106, 271/107

(56) References Cited

U.S. PATENT DOCUMENTS

| | | | | |
|---|---|---|---|---|
| 4,397,457 A | | 8/1983 | Hinchcliffe et al. | |
| 5,037,080 A | * | 8/1991 | Wirz | 271/107 |
| 5,094,439 A | * | 3/1992 | Renner et al. | 271/107 X |
| 5,863,037 A | * | 1/1999 | Jost | 271/11 X |
| 5,996,987 A | | 12/1999 | Leu et al. | |
| 6,155,555 A | * | 12/2000 | Maass | 271/107 X |

FOREIGN PATENT DOCUMENTS

| | | |
|---|---|---|
| DE | 40 12 779 C1 | 5/1991 |
| DE | 195 28 420 A1 | 2/1997 |
| EP | 0 585 924 A1 | 3/1994 |
| EP | 0 691 296 A1 | 1/1996 |
| EP | 0 806 391 A1 | 11/1997 |
| GB | 712337 | 7/1954 |
| GB | 2 077 240 A | 12/1981 |

* cited by examiner

*Primary Examiner*—David H. Bollinger
(74) *Attorney, Agent, or Firm*—Alston & Bird LLP

(57) ABSTRACT

An apparatus for feeding sheet-like articles, such as newspapers, periodicals, and inserts therefor, from a vertical stack of the articles. The stack is supported on a fixed rest 3, and a sucker arrangement 24 and a pushing away unit 38 are mounted on a load bearing structure 44 which is supported so as to float with the height of the stack. The sucker arrangement 24 includes a pair of suction heads 25 which are mounted for movement between a lowered extended position and a raised retracted position, and the suction heads have suction openings 25*a* which are permanently connected to a source of negative pressure. In operation, the suction heads 25 engage the uppermost one of the articles in the stack, which closes the suction openings 25*a* and causes the suction heads and uppermost article to be lifted. The pushing away unit 38 then engages and laterally moves the article away from the suction heads. The suction openings 25*a* are thereby opened and the heads are then biased to their extended positions in engagement with the next article in the stack. The sequence is then repeated.

12 Claims, 5 Drawing Sheets

APPARATUS FOR FEEDING SHEET-LIKE ARTICLES FROM A STACK

CROSS REFERENCE TO RELATED APPLICATION

The present application is a continuation of PCT/CH99/00529, filed Nov. 10, 1999, and designating the United States.

BACKGROUND OF THE INVENTION

The present invention relates to an apparatus for feeding sheet-like articles, in particular printed products such as, for example, newspapers, periodicals, parts thereof and inserts therefor, from a vertical stack thereof.

In a known apparatus of this type (EP-A-0806 391), a sucker arrangement is provided which comprises suction heads which are fitted on a rotor which is driven in rotation. The suction heads, which are connected to a negative-pressure source, are positioned from above on the respectively uppermost printed product of the stack. The printed product are then gripped under the action of the negative pressure acting on the suction opening of a suction head, and are raised off from the stack as the suction head moves further. The sucker arrangement brings the gripped printed product into the active region of a pushing arrangement, which comes to act on an edge of the raised-off printed product. At this point in time, the suction heads are disconnected from the negative-pressure source, as a result of which the gripped printed product is released and pushed away from the stack by the pushing arrangement.

The sucker arrangement thus serves only for raising the printed products off from the stack, while the pushing arrangement performs the task of transporting the printed products away.

This known apparatus requires a comparatively high level of mechanical outlay in order to control the movement of the suction heads. In addition, control means are necessary for periodically connecting the suction heads to the negative-pressure source and disconnecting them therefrom.

Also known are apparatuses which are intended for raising sheet-like articles off from a stack and transporting them away (EP-A-0 585 924 and GB-A-712,337) and have sucker arrangements in which the suction head is guided in a longitudinally displaceable manner in a guide. The suction head is retained in its front, receiving position by means of an elastically deformable restoring element, e.g. a compression spring. If the suction head, with the suction opening connected to the negative-pressure source, is positioned on the uppermost article of the stack, which results in the suction opening being closed, then the suction head automatically moves rearward, counter to the action of the restoring element, into a rear, discharge position. By virtue of this movement of the suction head, the gripped article is raised off from the stack. By virtue of the movement of the sucker arrangement together with the gripped article, the latter is conveyed away from the stack. For the release of the article conveyed away in this manner, the suction head is disconnected from the negative-pressure source.

These solutions thus require a control means for connecting the negative-pressure source to the suction opening of the suction heads and disconnecting it therefrom.

It is an object of the present invention described above, to provide an apparatus of the type with a relatively straightforward design and control which requires less outlay, and allows a stack to be reduced satisfactorily without the products being adversely affected.

SUMMARY OF THE INVENTION

The above and other objects and advantages of the present invention are achieved by the provision of an apparatus which comprises a rest for supporting a vertical stack of the articles, a sucker arrangement for lifting the uppermost one of the articles from the stack, and a pushing away mechanism for laterally moving the article which has been lifted from the stack by the sucker arrangement. The sucker arrangement includes at least one suction head which is mounted for movement in a is guide element between a lowered extended position where it engages the uppermost one of the articles in the stack, and a raised retracted position. Also, the suction head has a lower suction opening which is permanently connected to a negative pressure source, and a restoring element is provided for biasing the suction head toward its lowered position.

The specific design of the suction head and the particular design of the pushing away mechanism make it possible for the movement of the suction head to be controlled, without the suction opening being connected to the negative pressure source and disconnected therefrom, solely by the gripped sheet-like articles being pushed away from the suction opening.

BRIEF DESCRIPTION OF THE DRAWINGS

Exemplary embodiments of the subject matter of the invention are explained in more detail hereinbelow with reference to the accompanying drawings, in which, purely schematically.

DETAILED DESCRIPTION OF THE PREFERRED EMBODIMENTS

Figure 1:
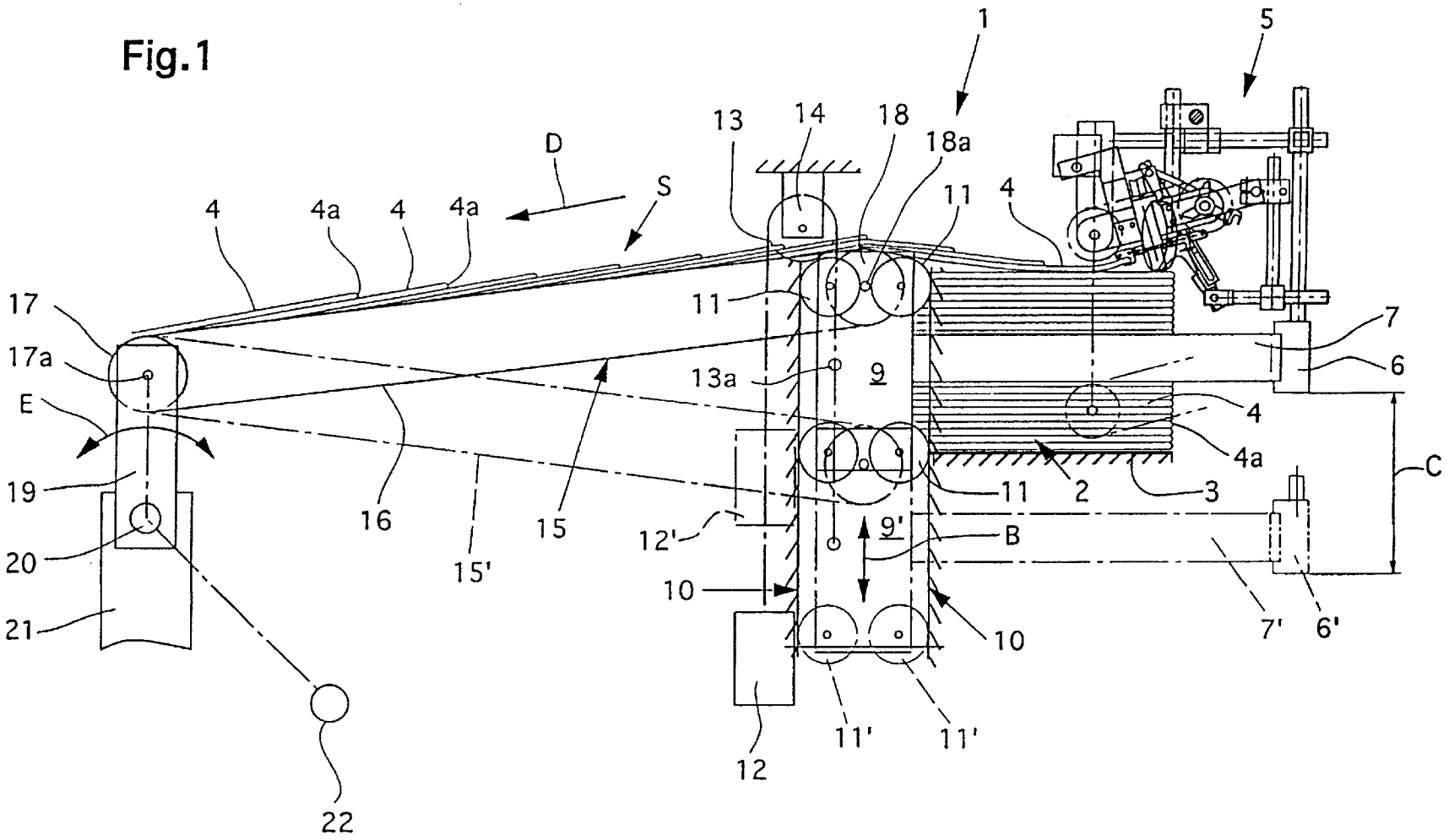
FIG. 1 is a side view of an apparatus for reducing a stack of sheet-like articles which embodies the present invention.

An apparatus 1 for reducing a stack 2 is shown in its entirety in FIG. 1. The stack 2 is supported on a rest 3 which is arranged at a given, fixed height. In the present exemplary embodiment, the stack 2 comprises printed products 4, which in this case are folded. These printed products 4 may be newspapers or periodicals and parts thereof or inserts therefor.

Figure 2:
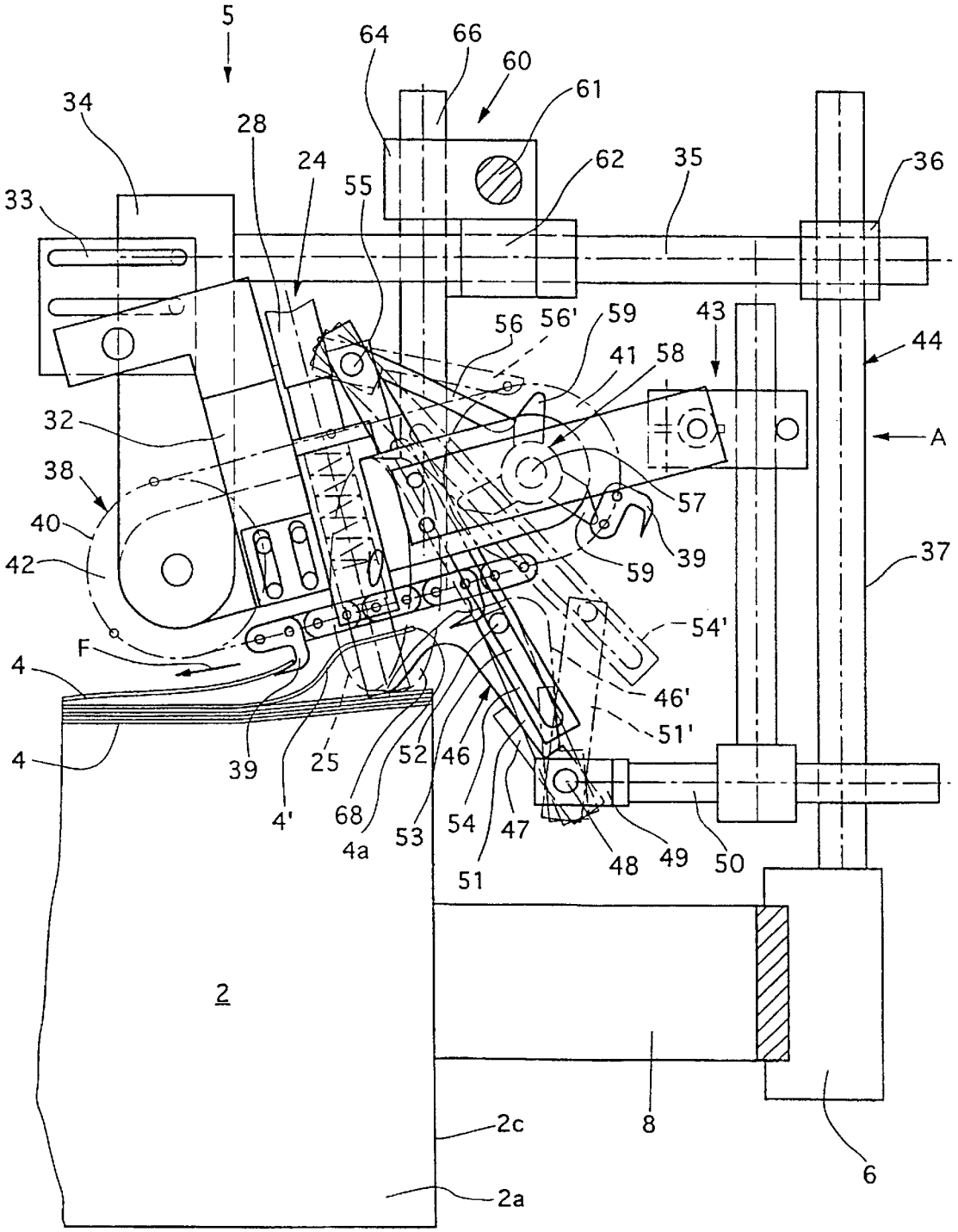
FIG. 2 shows, on an enlarged scale and likewise in side view, the structural unit for raising, and pushing the articles away from the stack.
Figure 3:
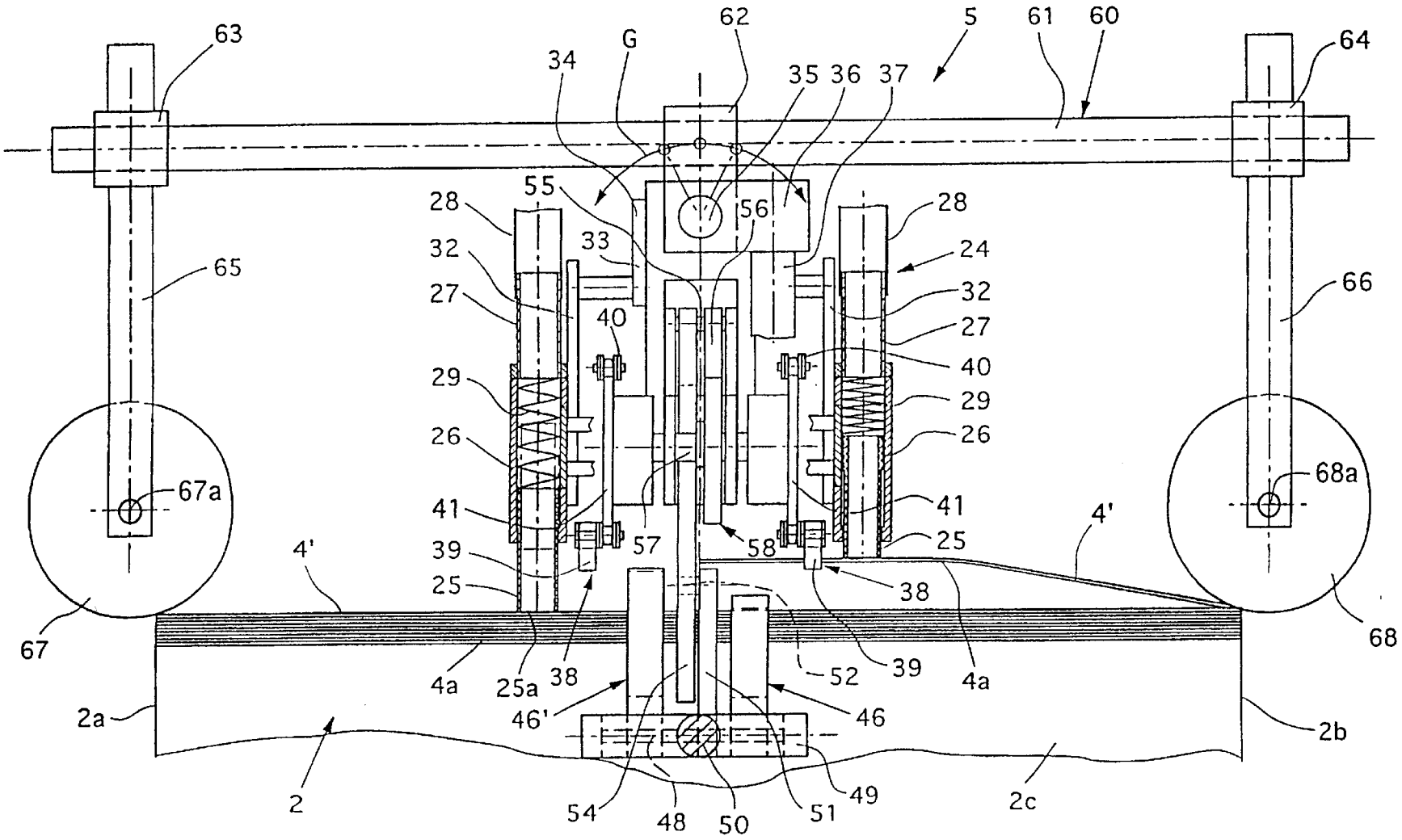
FIG. 3 is a view taken in the direction of the arrow A in FIG. 2, of the structural unit shown in FIG. 2.

In order to raise, and to push away, the respectively uppermost printed product 4 from the stack 2, a raising and pushing off unit is provided, the unit being designated 5 and being shown on an enlarged scale in FIGS. 2 and 3. This raising and pushing-off unit 5 is fastened on a transverse carrier 6 which is connected to two connecting carriers 7, 8, which are each arranged adjacent the sides of the stack 2.

The two connecting carriers 7, 8 are connected to a carriage 9 which is guided in a schematically indicated longitudinal guide 10 such that it can be displaced longitudinally in the direction of the arrow B, i.e. such that it can be ajusted in height. Guide rollers 11 are provided on the carriage 9 and are supported on the longitudinal guide 10. Acting on the carriage 9 is a balance weight 12 which is connected to the carriage 9 by means of a drawing element 13. The location at which the drawing element 13 is fastened on the carriage 9 is designated 13*a*. The drawing element 13 is guided over a stationary, rotatably mounted deflecting roller 14. Instead of the balance weight 12, it is also possible to use a cylinder/piston unit or a pneumatic spring.

A removal conveyor 15 is provided in order to remove the printed products 4 raised from the stack 2. The conveyor is designed as a rocker and, in the present case, is formed by a belt conveyor. The latter has one or more conveying belts 16 which are arranged one beside the other and guided over deflecting rollers 17 and 18. The deflecting roller 18 is mounted in the carriage 9 by way of its rotary spindle 18*a* and thus moves along with the lifting movement of the carriage 9. The other deflecting roller 17 is mounted in two bearing arms 19 by way of its rotary spindle 17*a*, only one bearing arm being visible in FIG. 1. The bearing arms 19 are seated on a bearing spindle 20, which is mounted rotatably in a framework 21 (only illustrated in part). A schematically indicated drive motor 22 serves for driving the belt conveyor 15 in the direction of the arrow D.

As can be seen from FIG. 1, the printed products 4 raised from the stack 2 are conveyed away in an imbricated formation S in which each printed product 4 rests on the following printed product. The trailing edges 4*a* of the printed products 4, which in the present case are the folded edges, are thus exposed in the imbricated formation S.

In FIG. 1, the carriage 9 is shown in the top end position. The bottom end position of the carriage 9 is indicated by chain-dotted lines and designated 9'. In this bottom end position of the carriage 9, the guide rollers and the balance weight assume the position indicated at 11' and 12', respectively. The possible displacement travel of the carriage 9 is specified by the arrow C. In this bottom end position of the carriage 9, the removal conveyor 15 and the carriers 6, 7 and 8 also assume a bottom position, which is likewise depicted by chain-dotted lines in FIG. 1.

The construction of the raising and pushing off unit will now be explained in more detail hereinbelow with reference to FIGS. 2, 3 and 4.

This raising and pushing off unit 5 has a sucker arrangement 24 containing two suction heads 25 spaced apart one beside the other. Each suction head 25 has a suction opening 25*a* (FIG. 4). The suction heads 25 are guided in a longitudinal guide 26 and can be displaced in the direction of their longitudinal axis. The hollow cylindrical longitudinal guides 26 each have likewise hollow cylindrical connection stubs 27 (FIG. 3) connected to them. Connected to the connection stubs 27 are connecting lines 28, which lead to a negative pressure source (not illustrated specifically). Each suction opening 25a is thus in permanent connection with the negative pressure source via the longitudinal guide 26, the connection stub 27 and the connecting line 28.

Figure 4:
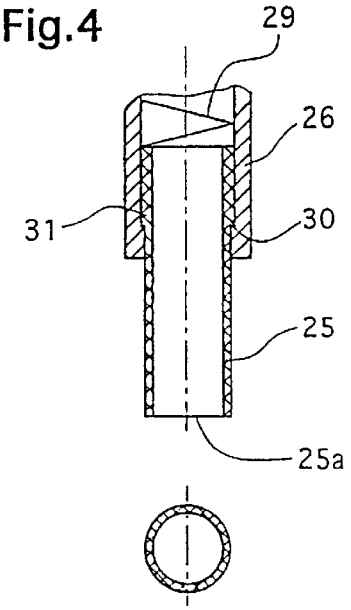
FIG. 4 shows the suction head in longitudinal section.

Arranged between each suction head 25 and the fixed connection stub 27 is a compression spring 29, which biases the suction head 25 toward its extended, receiving position, which is shown on the left-hand side in FIG. 3 and in FIG. 4. In order to prevent the suction heads 25 from being forced out of the longitudinal guides 26, an annular shoulder 30 is formed (FIG. 4) on each longitudinal guide 26. The annular shoulder interacts with an annular protrusion 31 on the suction head 25 in the extended end position of the suction head 25.

Each longitudinal guide 26 is fastened on a securing element 32, which is connected to a connecting part 33. The latter is fastened on a bearing part 34, which is connected to a longitudinal carrier 35. A connecting element 36 connects the longitudinal carrier 35 to a load bearing column 37, which is fastened on the transverse carrier 6.

The raising and pushing off unit 5 also contains two pushing away units 38, which are likewise spaced apart one beside the other. Each pushing away unit 38 is located in the vicinity of a suction nozzle 25, as FIG. 3 shows. Each pushing away unit 38 has a number of pushing away protrusions 39, which are fastened at regular intervals on an endless conveying chain 40. Each of these conveying chains 40 is guided over deflecting wheels 41 and 42. As is shown, but not described in any more detail, the deflecting wheels 41, 42 are fastened rotatably in a load bearing framework 44 formed by the already mentioned structural elements 34–37 and a fastening linkage 43 (FIG. 2). A deflecting wheel of each pushing away unit 38, e.g. the deflecting wheel 42, is driven in the clockwise direction via a drive (not illustrated), which results in the pushing away protrusions 39 being moved in the direction of the arrow F.

The raising and pushing off unit 5 also has two holding down elements 46 spaced apart one beside the other. Each holding down element 46 is fastened on a securing means 47 (FIG. 2), which is seated in a rotationally fixed manner on a shaft 48. This shaft 48 is mounted rotatably in a mounting part 49, which is fastened on a carrier 50 belonging to the fastening linkage 43. Connected to the shaft 48 is a lever 51 which engages in an elongate guide slot 53 in a control lever 54 by way of a bolt 52. The control lever 54 is seated on a shaft 55, which is mounted rotatably in a load bearing framework 44 in a manner which will not be described in any more detail. A control lever 56 is fixed to the shaft 55. The control lever 56 interacts with a control element 58 which is fastened on the common shaft 57 of the deflecting wheels 41, and thus rotates along with the deflecting wheels 41, and has projecting control fingers 59 (FIG. 2). In the present case, three control fingers 59 are provided, these acting on the control lever 56, and raising the same, periodically in each case. The action of raising the control lever 56 results in the control lever 54 being pivoted into the position which is shown by chain-dotted lines in FIG. 2 and is designated 54'. By virtue of the movement of the control lever 54, the lever 51 is pivoted into the position designated 51', which results in the holding-down elements 46 being pivoted rearward into the position designated 46' in FIG. 2.

The raising and pushing-off unit 5 also has a supporting arrangement 60, which serves for supporting the load-bearing framework 44 and the load-bearing structure, formed by the carriers 6, 7 and 8, on the stack 2. This supporting arrangement 60 contains a transverse carrier 61, which is supported on the longitudinal carrier 35 of the load-bearing framework 44 via a connecting element 62. The connecting element 62 is mounted pivotably on the longitudinal carrier 35. It is thus possible for the connecting element 62 and the transverse carrier 61 to execute an oscillating movement about the longitudinal axis of the longitudinal carrier 35. This pivoting or oscillating movement is indicated by the arrow G in FIG. 3.

Fastened on the transverse carrier 61 are connecting elements 63, 64 in which load-bearing bars 65 and 66 are respectively retained, the longitudinal axes of the bars running essentially at right angles to the longitudinal axis of the transverse carrier 61. A supporting wheel 67, 68 is mounted rotatably at the bottom, free end of each load-bearing bar 65, 66, respectively. These supporting wheels 67, 68 rest on the stack in the region of the side edges 2*a*, 2*b*, in the corners of the stack 2. As can be seen from FIG. 2 in particular, the supporting wheels 67, 68 are positioned obliquely. This means that the axes of rotation 67*a*, 68*a* of the supporting wheels 67, 68 run transversely, that is to say neither parallel nor at right angles, to the side surfaces 2*a*, 2*b*, 2*c* of the stack 2.

It can be gathered from the description of the construction of the apparatus 1 for reducing the stack 2 which has been provided to this point that the raising and pushing-off unit 5, which is supported on the stack 2 via the supporting arrangement 60, follows the stack 2 as the latter is being reduced, which has yet to be described. The load bearing structure, which is formed by the carriers 6, 7, 8, is thus lowered with the carriage 9, guided in the guide 10, the load bearing framework 44 and the components fastened on the latter, as the stack 2 is being reduced. As FIG. 1 shows, the removal conveyor 15 also moves along with this lowering movement of the structural unit 5 and of the carriage 9, the bearing arms 19 thus pivoting in the direction of the arrow E.

The functioning of the raising and pushing off unit 5 will now be described hereinbelow with reference, in particular, to FIGS. 2 to 7.

Figure 5:
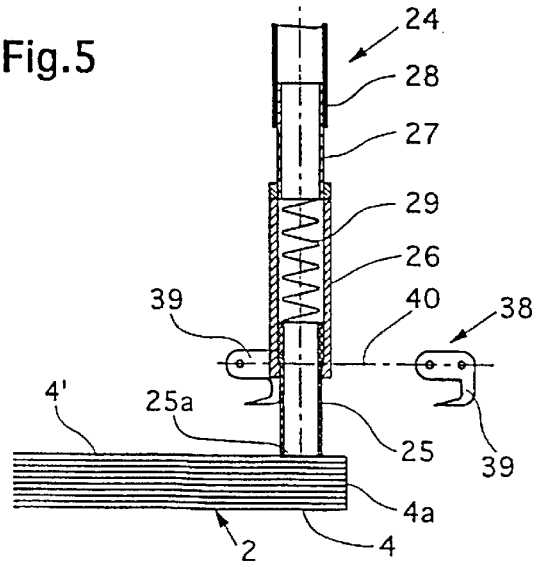
FIGS. 5 to 7 are simplified illustrations of the functioning of the structural unit for raising, and pushing away, the articles from the stack.

The suction heads 25 are fixed in height in relation to the supporting wheels 67, 68 such that, in their extended, receiving position, the suction heads 25 rest on the respectively uppermost printed product 4' of the stack 2 by way of the suction opening 25*a*, as is shown on the left-hand side in FIG. 3 and in FIG. 5. In this position of the suction heads 25, the suction opening 25*a* thereof, which is connected permanently to the negative pressure source, is closed by the uppermost printed product 4'. A negative pressure is then produced in the interior of the suction heads 25. This results in the suction heads 25 being raised together with the gripped printed product 4' and moving, counter to the action of the compression springs 29, from the extended, receiving position into the retracted position. This means that the uppermost printed product 4' is lifted from the stack 2 in the region of its trailing edge 4*a* and moved into the movement path of the pushing away protrusions 39 (FIG. 1, FIG. 2, FIG. 3, right-hand side, FIG. 6).

Figure 6:
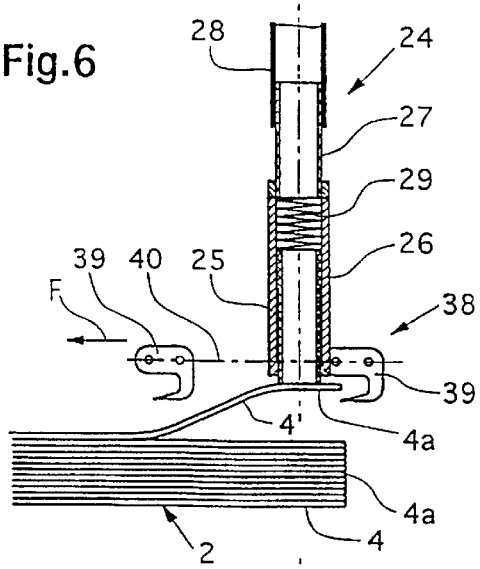
Figure 7:
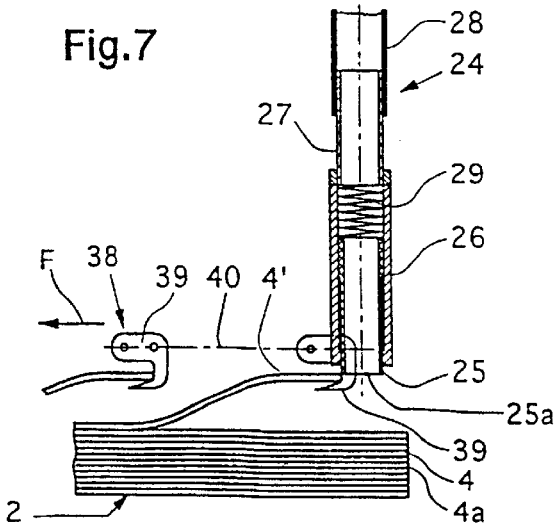

The next pushing away protrusion 39 comes to act on the raised printed product 4' in the region of its trailing edge 4*a* and, as it moves further in the direction of the arrow F, pushes the uppermost printed product 4' away from the stack 2, as FIGS. 1, 6 and 7 show. At the beginning of the displacement path of the uppermost printed product 4', the suction openings 25*a* of the suction heads 25 are still closed (FIG. 6), but are released to an increasing extent. As soon as the gripped printed product 41 has been pushed away in its entirety from the suction opening 25*a* of the suction heads 25, the suction heads 25 return, under the action of the compression spring 29, into their front, receiving position, in which, as has been mentioned, they come to rest on the next printed product 4 by way of their suction openings 25*a*. As a result, the above described lifting operation begins anew.

The pushing-away protrusions 39 of the pushing away units 38 move the printed products 4 into the active region of the removal conveyor 15, by means of which the printed products 4 pushed away from the stack 2 are removed in an imbricated formation S (FIG. 1). It should be pointed out here that it is, of course, also possible for the spacings between the pushing away protrusions 39 to be selected such that the pushed off printed products 4, rather than overlapping on the removal conveyor 15 and thus being conveyed away in an imbricated formation S, are conveyed away one behind the other. It is possible to adjust the phase position of the pushing away protrusions 39 in relation to the lifted printed products 4, as a result of which it is possible to coordinate the point in time at which the printed products 4 are pushed away.

As FIGS. 2 and 3 show, the holding down elements 46 are located in a rear, standby position when the suction heads 25 assume their front, receiving position and rest on the uppermost printed product 4'. This standby position is depicted by chain-dotted lines, and designated 46' in FIG. 2 and is illustrated on the left-hand side in FIG. 3. As the suction heads 25 move away from the stack 2 in the manner described, the holding down elements 46, controlled by the control fingers 59, the control lever 54 and the lever 51, are moved against the top side of the stack 2. They come to rest on top of the stack 2 in an active position in the region of the trailing edge 4*a* of the printed products 4 as soon as the uppermost printed product 4' has been raised from the stack 2 by the suction heads 25, but before the uppermost printed product 4' has been pushed away. This active position of the holding down elements 46 is illustrated by solid lines in FIG. 2 and on the right-hand side in FIG. 3.

The holding down elements 46, which press on the stack 2 from above in their active position, are intended to ensure that, as the previously raised printed product 4' is being pushed away by the pushing away protrusions 39, the printed product 4 located therebeneath is not carried along with it.

As soon as the control lever 56 runs off the control finger 59, the holding down elements 46 are pivoted back into their retracted, standby position.

Figure 8:
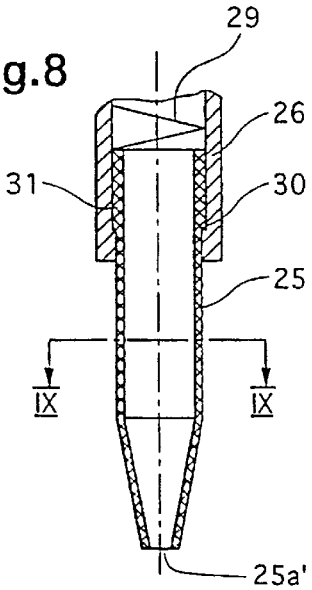
FIG. 8 is a longitudinal section of another embodiment of the suction head.
Figure 9:
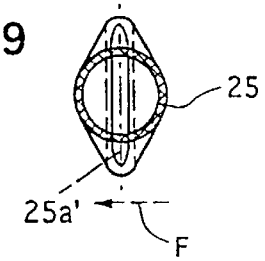
FIG. 9 is a section along line IX—IX in FIG. 8, and FIGS. 10 and 11 show two possible solutions for charging the stack.

As has been described, the suction heads 25 are moved out of their retracted, discharge position into the extended, receiving position again as soon as their suction openings 25*a* have been released. This makes it possible to reduce the period of time taken by an operating cycle of the suction heads 25 with the suction openings 25*a* being of the smallest possible dimension in the pushing-off direction F. In order nevertheless to achieve a sufficiently large suction opening 25*a*, it is the case in a preferred embodiment that the suction opening 25*a*' is designed in the manner of a longitudinal slot, as is illustrated in FIGS. 8 and 9. The suction opening 25*a*', designed as a slot-type nozzle, extends here in a direction which forms an angle of approximately 90° with the pushing-off direction F.

Two variants for charging the stack 2 which is to be reduced will be explained with reference to FIGS. 10 and 11.

Figure 10:
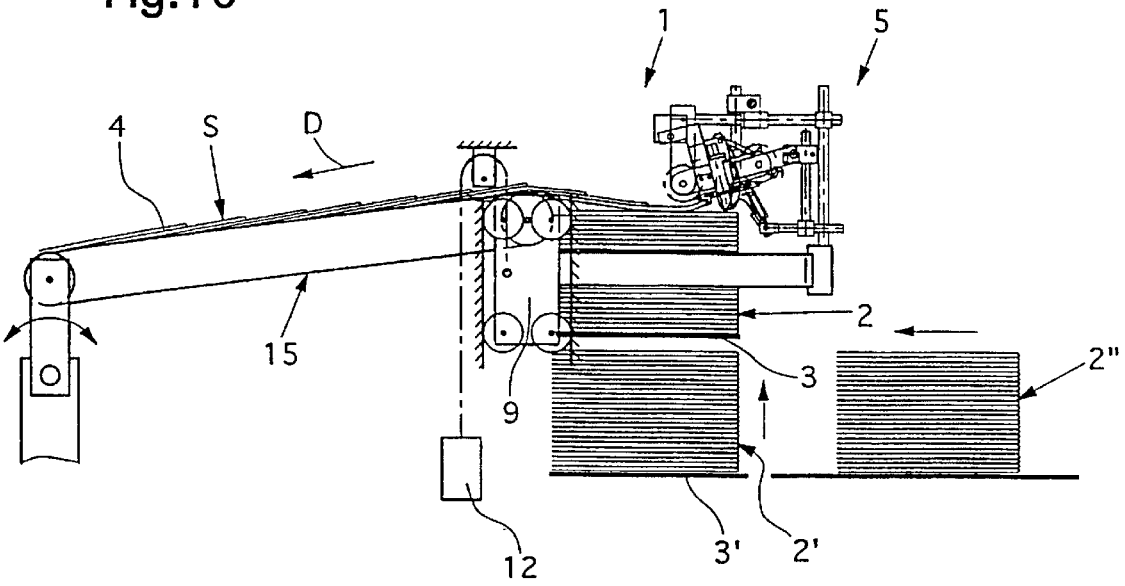

In the embodiment according to FIG. 10, a new stack 2' is moved in beneath the rest 3, on which the stack 2 is located. Once the stack 2 has been reduced almost completely, then the stack 2' located therebeneath can be pushed upward in a manner which is not illustrated specifically. The stack 2' can be pushed up in this way either during a break in the stack-reducing operation or as the stack 2 is being reduced. The rests 3, 3' alternately perform the stack supporting function.

In FIG. 10, 2" designates a further stack which, once the stack 2' has been pushed up into the stack reducing position, is displaced to the location of said stack 2'.

Figure 11:
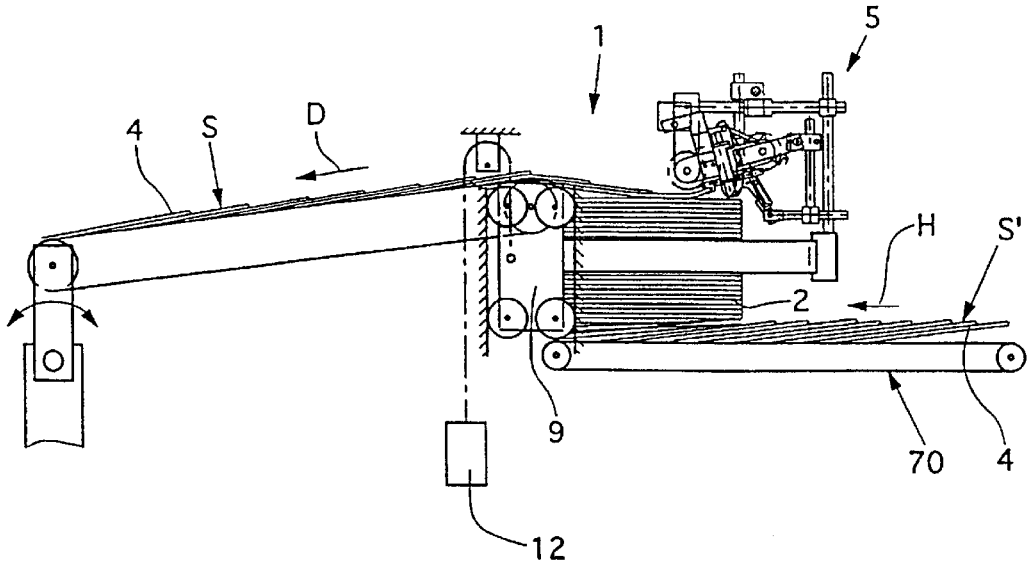

In the embodiment which is shown in FIG. 11, new printed products 4 are constantly fed to the stack 2 from beneath, the printed products being fed in an imbricated formation S', in the direction of the arrow H, by means of a feed conveyor 70. In the imbricated formation S', each printed product 4 rests on the following printed product in each case. The charging of the stack 2 thus takes place in a manner similar to that for the apparatus according to EP-A-0 806 391, mentioned in the introduction, the difference being that the feed conveyor 70, rather than having to be designed as a rocker, may be arranged such that its position cannot be changed. This is possible because, on account of being supported on the top side of the stack and being mounted in a moveable manner, the raising and pushing off unit 5 is capable of following the changing level of the top side of the stack 2. The feed conveyor 70 performs the function of the fixed height rest 3 of the apparatus 1 shown in FIGS. 1 and 10.

A considerable advantage of the apparatus according to the invention can also be gathered from what has been said above. This is because the apparatus according to the invention does not require the height of the rest 3 or of the feed conveyor 70 to be controlled such that the top side of the stack 2 is always at the same level, because the raising and pushing off unit 5 is capable of following the changing height of the top side of the stack 2.

It goes without saying that various components, in particular the pushing away units 38 and the holding down elements 46 and the drive thereof, may also be designed in a manner other than that which has been described and shown. It is possible, for example, for the printed products 4 lifted by the suction arrangement 24 to be pushed away by means of a pushing arrangement as has been described in the previously mentioned EP-A-0 806 391.

In the exemplary embodiments shown, the printed product 4 secured by the suction heads 25 in each case is pushed away from the suction heads 25 by the pushing away protrusions 39 of the pushing away units 38 in order to release the suction opening 25*a* of the suction heads 25. In other words, the pushing away protrusions 39 move past the fixed suction heads 25.

In order for the gripped printed products 4 to be pushed away from the suction heads 25, it is also possible, with otherwise the same functioning of the suction heads 25, for the latter to be moved, together with the gripped printed product 4, against stationary stops. The gripped printed product 4 positioned against these stops is prevented from moving further and the suction heads 25 slide off the printed product 4 as they move further, which results in the suction openings 25*a* being released. The suction heads 25 are then moved away from the stops again back into the starting position, in order to grip the next printed product. This requires a corresponding control means and extends the duration of an operating cycle.

What is claimed is:

1. An apparatus for feeding sheet-like articles from a vertical stack thereof, comprising a rest for supporting a vertical stack of the articles, a sucker arrangement for lifting the uppermost one of the articles from the stack, a pushing away unit for laterally moving the article which has been lifted from the stack by the sucker arrangement, said sucker arrangement including at least one suction head which is mounted for movement in a guide element between a lowered extended position where it engages the uppermost one of the articles in the stack, and a raised retracted position, said suction head having a lower suction opening which is permanently connected to a negative pressure source, and a restoring element for biasing the suction head toward its lowered position, wherein when the suction head is in its lowered position and engages the uppermost one of the articles in the stack, the suction opening is closed by the article and the negative pressure causes the suction head to move toward its raised position against the biasing force of the restoring element and thereby lift the engaged article, and wherein the pushing away unit then engages and laterally moves the lifted article so as to remove the article from the sucker arrangement and open the suction opening, and wherein the suction head is then moved to its lowered position by the restoring element so as to engage the next uppermost article in the stack.

2. The apparatus as defined in claim 1 further comprising a load bearing structure which is mounted for displacement in a substantially vertical direction above the rest, and which mounts the sucker arrangement and the pushing away unit.

3. The apparatus as defined in claim 2 wherein the load bearing structure includes a supporting arrangement which includes at least one supporting element which is positioned to rest upon the stack, so that the load bearing structure is supported at an elevation determined by the height of the stack.

4. The apparatus as defined in claim 3 wherein the supporting arrangement includes at least two spaced apart supporting elements which are positioned to rest upon opposite edges of the stack.

5. The apparatus as defined in claim 4 wherein the pushing away unit defines a lateral advancing direction in which the raised sheet is moved.

6. The apparatus as defined in claim 5 wherein the supporting elements comprise rotatably mounted supporting wheels which have axes which are each disposed at an angle other than 90 degrees with respect to the advancing direction.

7. The apparatus as defined in claim 5 wherein the suction opening is in the form of a slot which extends transversely to the advancing direction.

8. The apparatus as defined in claim 3 wherein the pushing a way unit comprises a plurality of carrying along elements which are spaced apart from each other and mounted for movement along an endless path of travel so that the carrying along elements sequentially engage an edge of each article lifted by the sucker arrangement.

9. The apparatus as defined in claim 3 further comprising at least one holding down element mounted to the load bearing structure and which is moveable between a lowered active position in engagement with the uppermost article in the stack and a raised standby position, and a drive for periodically moving the holding down element between its lowered and raised positions in synchronism with the movement of the suction head so that the holding down element subjects the next uppermost article to a restraining force as the uppermost article is lifted by the suction head.

10. The apparatus as defined in claim 3 wherein said rest is mounted at a fixed elevation.

11. The apparatus as defined in claim 10 wherein the load bearing structure is mounted to a carriage which is mounted for movement along a guide which extends substantially in the vertical direction.

12. The apparatus as defined in claim 11 further comprising a removal conveyor having an entry end mounted to the carriage and so as to receive the lifted articles as they are serially removed from the suction head by the pushing away unit.

* * * * *